US006312282B1

(12) United States Patent
Blaha et al.

(10) Patent No.: US 6,312,282 B1
(45) Date of Patent: Nov. 6, 2001

(54) INSULATION DISPLACEMENT CONNECTOR

(75) Inventors: William E. Blaha, St. Charles; Kenneth W. Stanevich, Sycamore, both of IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 09/272,530

(22) Filed: Mar. 22, 1999

(51) Int. Cl.[7] ..... H01R 4/24
(52) U.S. Cl. ..... 439/402
(58) Field of Search ..... 439/402, 465, 439/467, 687, 689, 696, 475, 409, 596, 731

(56) References Cited

U.S. PATENT DOCUMENTS

| | | | |
|---|---|---|---|
| 1,290,153 | | 1/1919 | Fitzpatrick . |
| 1,488,636 | | 4/1924 | Geiser . |
| 2,408,045 | | 9/1946 | Cottrell . |
| 2,704,832 | | 3/1955 | Greenbaum . |
| 2,735,078 | | 2/1956 | Greenbaum . |
| 3,408,616 | | 10/1968 | Greenbaum . |
| 3,500,292 | | 3/1970 | Enright et al. . |
| 3,745,228 | | 7/1973 | Vogt . |
| 3,845,236 | | 10/1974 | Anderson . |
| 3,971,616 | | 7/1976 | Hashimoto . |
| 4,037,905 | | 7/1977 | Lucas . |
| 4,047,784 | | 9/1977 | Trank . |
| 4,341,430 | | 7/1982 | Crawford . |
| 4,413,872 | | 11/1983 | Rudy, Jr. et al. . |
| 4,426,125 | | 1/1984 | Crawford . |
| 4,455,058 | | 6/1984 | Harner et al. . |
| 4,461,528 | | 7/1984 | Durand et al. . |
| 4,684,195 | | 8/1987 | Anderson et al. . |
| 4,995,829 | | 2/1991 | Geib et al. . |
| 4,995,830 | | 2/1991 | Eckhaus . |
| 5,030,133 | | 7/1991 | Rudoy . |
| 5,106,323 | | 4/1992 | Gerhard . |
| 5,154,632 | | 10/1992 | Ijiri . |
| 5,286,219 | * | 2/1994 | Ueno et al. ..... 439/475 |
| 5,451,167 | * | 9/1995 | Zielinski et al. ..... 439/92 |
| 5,697,812 | * | 12/1997 | Sampson ..... 439/567 |
| 5,746,610 | * | 5/1998 | Shiu ..... 439/98 |
| 5,873,850 | * | 2/1999 | Flower et al. ..... 604/20 |
| 5,924,888 | * | 6/1999 | Larkin ..... 439/410 |
| 6,024,597 | * | 2/2000 | Lok ..... 439/497 |
| 6,080,006 | * | 6/2000 | Broder ..... 439/409 |

* cited by examiner

*Primary Examiner*—Gary Paumen
*Assistant Examiner*—Phuong Nguyen
(74) *Attorney, Agent, or Firm*—Cook, Alex, McFarron, Manzo, Cummings & Mehler, Ltd.

(57) ABSTRACT

An insulation displacement connector has a plastic housing including a cover hinged to a case with a conductive clip mounted to the interior surface of the cover. Mechanical latches on the cover and case provide a pre-latch feature during installation of wires and prevent the easy opening of the housing after it has been closed. The housing has funnel-shaped wire entry openings with pre-closure retention members for holding wires inserted into a still open connector. The conductive clip has a base and tines extending from the base. The tines are arranged to impinge on the conductors in a plane normal to the axis of the conductors. The tines are coined to act as a knife edge to reduce the cutting force. The conductive clip's base is mounted such that the closing forces are distributed and the clip will break loose from the cover if an attempt is made to reopen the connector.

16 Claims, 3 Drawing Sheets

INSULATION DISPLACEMENT CONNECTOR

BACKGROUND OF THE INVENTION

This invention relates to wire connectors of the insulation displacement type. While the connector of the present invention can be used to connect wires in a wide range of applications, it is particularly suited for connecting a replacement ballast in a fluorescent light fixture. Electricians replacing a ballast in a fluorescent light fixture generally find it most efficient to remove the electrical connections to the old ballast by simply cutting the wires to the ballast. After mounting the new ballast in the fixture a fast, easy way to make a reliable electrical connection is needed. Insulation displacement connectors (IDC) can be used to save the time otherwise needed for stripping the insulation from the ends of the newly-cut wires. An IDC has a conductive contact element, referred to herein as a clip, that cuts through the insulation of two or more wires to be connected. The clip is thus placed in direct contact with the underlying conductors, providing electrical continuity between the conductors. Examples of this type of connector are shown in U.S. Pat. Nos. 4,461,528 and 3,845,236.

For an IDC to make reliable connections, it must have a way to pierce the wire insulation and drive its clip into direct contact with the underlying conductors. This can be a difficult task, especially with some types of tougher insulation such as nylon on top of PVC. The clip may be provided with sharpened knife edges to facilitate penetration of the insulation but the knife edges are difficult to form and therefore significantly increase the manufacturing cost of the connector. Another approach to making reliable electrical contact is to use a dual engagement clip. Such a clip has a base with two aligned sets of fingers or tines engaging each wire being connected. This increases the holding or gripping ability of the connector and doubles the opportunity to make a solid electrical connection. While a dual engagement clip increases the force required to cut through the insulation, various forms of pliers can easily supply the required force. However, the closure forces developed by pliers can wreak havoc on the plastic housings normally supplied with IDC connectors. To avoid this problem prior IDC connectors either close by hand without tools (U.S. Pat. No. 4,461528 or locate the clip external to the housing (U.S. Pat. No. 3,845,236) where it engages the pliers directly. After the clip is driven home by the pliers, a portion of the housing must be wrapped around the exposed clip to insulate it. The resulting two-step process takes longer to complete than a connector that can be closed in one step.

SUMMARY OF THE INVENTION

The present invention relates to an insulation displacement connector for joining two or more conductors. The connector comprises a housing having a case and cover pivotally connected thereto by a hinge. The housing has external ribs to provide sufficient strength to withstand closure forces developed by a variety of types of pliers. Two sets of mechanical latches provide a pre-latch feature during installation of wires and prevent the easy opening of the housing after it has been closed. The latches also provide audible and tactile indication of complete closure. The housing has funnel-shaped wire entry openings with pre-closure retention members for holding wires inserted into a still open connector. The IDC of this invention also has internal cradles which restrain the conductors from moving with respect to the clip and prevent the clip from deforming during penetration of the insulation.

The connector of the invention has a dual engagement clip contained within the housing. The conductive clip has a flat base with tines extending therefrom. The tines are arranged to impinge on the conductors in a plane normal to the axis of the conductors. The tines are coined to act as a knife edge to reduce the cutting force required to penetrate the insulation. The mounting of the conductive clip in the housing is such that the clip is fully supported during closure of the housing cover but the clip will break loose from the cover if an attempt is made to reopen the housing. Closing forces are distributed over a large enough portion of the cover to avoid stress concentrations that could otherwise cause failure of the housing.

DETAILED DESCRIPTION OF THE INVENTION

Figure 1:
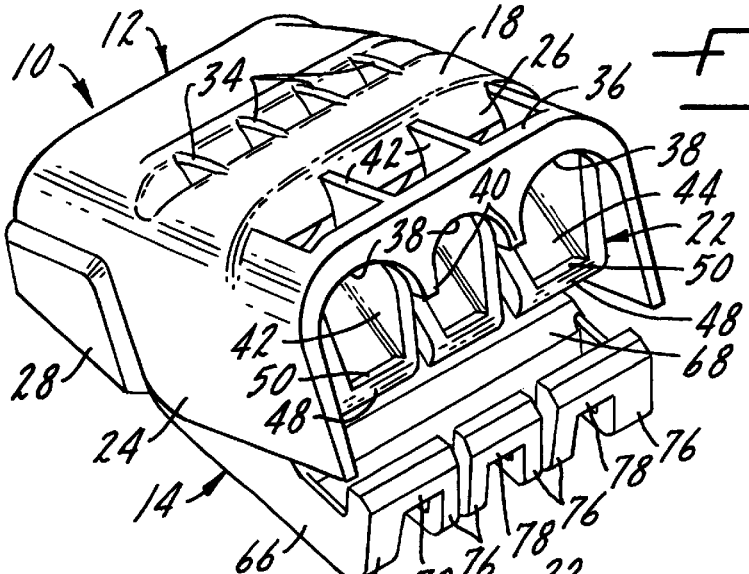
FIG. 1 is a perspective view of a partially closed connector according to the present invention.
Figure 2:
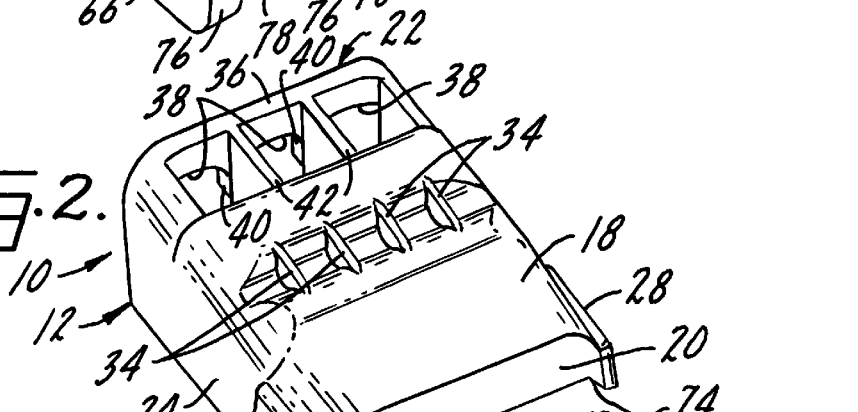
FIG. 2 is a perspective view of the exterior of a fully open connector.
Figure 3:
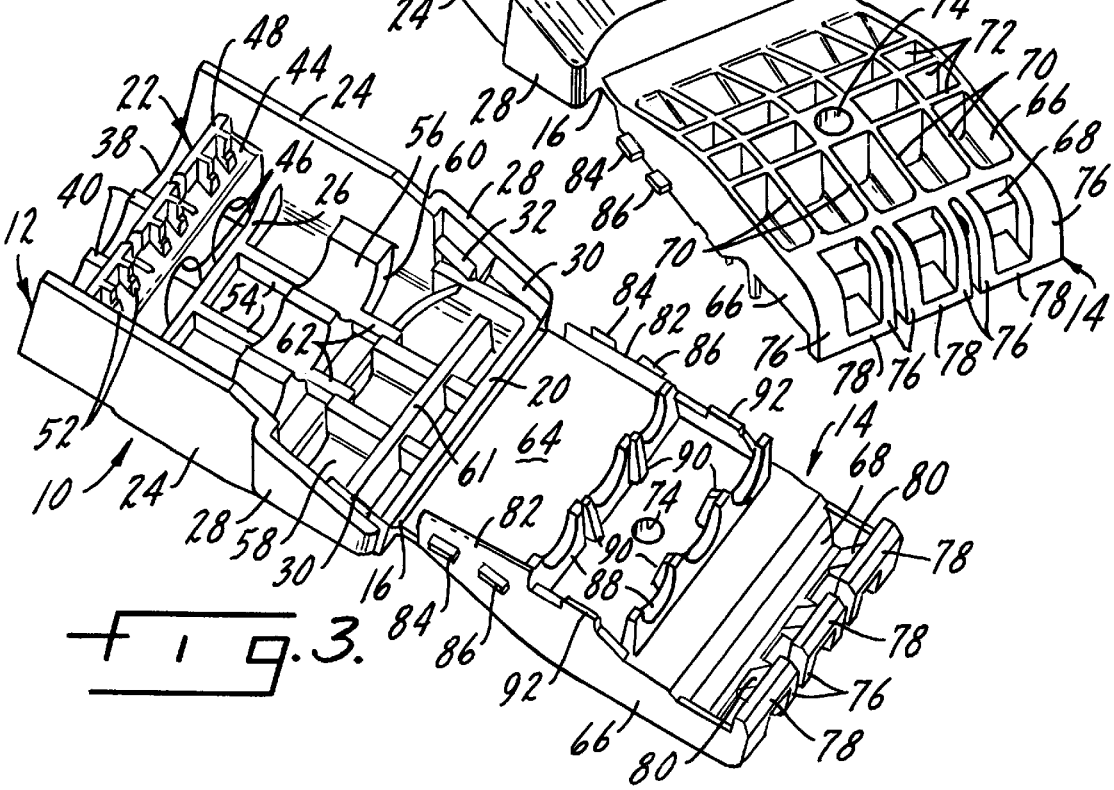
FIG. 3 is a perspective view of the interior of a fully open connector.

FIGS. 1–3 illustrate the housing 10 of an electrical connector according to the present invention. The housing is a six-sided enclosure having openings for permitting insertion of electrical conductors. The housing surrounds a conductive clip which engages all inserted conductors and electrically joins them. The housing 10 is electrically insulative and is preferably made of a thermoplastic material, for example nylon. It includes two main parts, a case 12 and a cover 14. These parts are joined by a hinge 16. Preferably the case and cover are integrally molded and the hinge is a living hinge but it could be otherwise. The case and cover are movable relative to one another about the axis defined by the hinge. The parts are rotatable about the hinge from an open position shown in FIGS. 2 and 3 to a closed position. The connector in FIG. 1 is shown partially closed.

Looking first at the construction of the case 12, it is generally a five-sided enclosure defined by a bottom wall 18, an end wall 20, a conductor entry structure 22, and two side walls 24. The front edge of the bottom wall 18 terminates at a lip 26. The junction between the bottom wall 18 and side walls 24 is curved or rounded as seen in FIGS. 1 and 2. The side walls extend beyond the lip 26 and thus enclose the conductor entry structure 22. At the other end of the side walls 24 there are outwardly offset portions 28. The offset portions 28 each carry inwardly projecting first and second lugs 30 and 32, the purpose of which will be explained below. As seen in FIGS. 1 and 2, the exterior surface of the bottom wall 18 has four longitudinal strengthening ribs 34.

Figure 6:
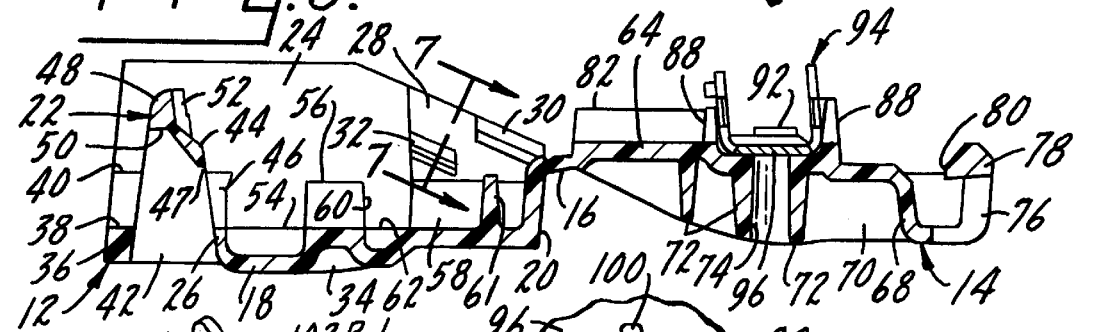
FIG. 6 is a section taken along line 6—6 of FIG. 4.

The conductor entry structure 22 is a rather complex construction. It includes a transverse beam 36 that joins the two side walls 24. The exterior side of the beam 36 is flat while the opposite side has three U-shaped stirrups 38 formed therein. The central stirrup joins its neighbors at flats 40 while the outside edges of the outer stirrups merge into the side walls 24. Behind the flats 40 are two partitions 42. The partitions are longitudinally extending walls that join the beam 36 to the lip 26 and to a transverse guide wall 44. The guide wall 44 extends from one side wall to the other and has U-shaped bridges 46 (FIG. 3) on its interior, bottom side. The bridges 46 merge with the partitions 42 and side walls 24. As best seen in FIG. 6, the guide wall 44 is angled toward the openings 47 defined by the bridges, partitions and side walls so as to funnel conductors thereto. On the upper surface of the guide wall 44 there are three somewhat rounded ramp surfaces 48 that terminate at a flat, horizontal catch 50. Each ramp is supported by two braces 52. The ramp 48 and catch 50 cooperate with mating hooks on the cover to hold the housing in a closed position.

Figure 4:
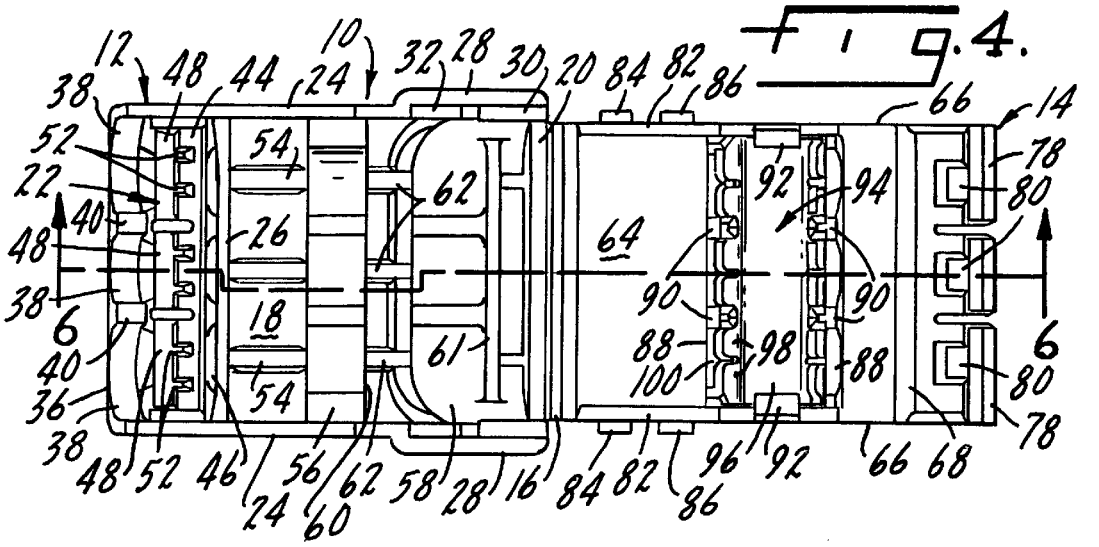
FIG. 4 is a plan view of the interior of a fully open connector.
Figure 5:
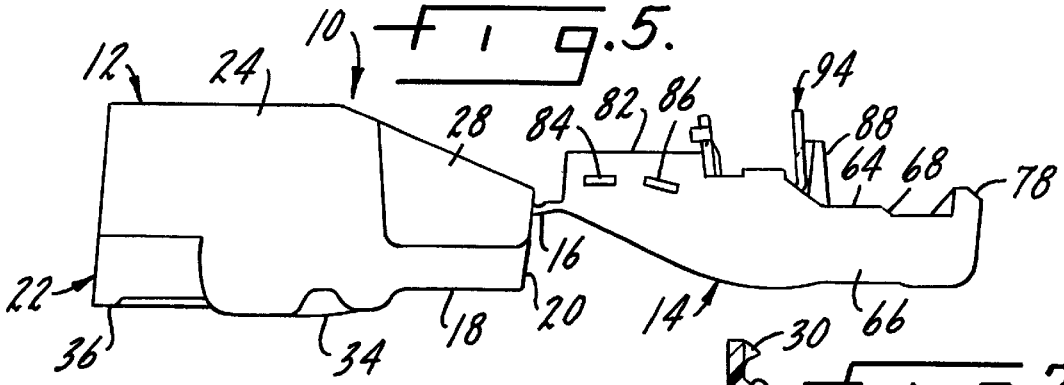
FIG. 5 is a side elevation view of a fully open connector.

FIGS. 4–6 illustrate the internal features of the case 12. There is a first set of three ledges 54 on the bottom wall 18. The ledges match the height of the lip 26 and extend from the lip to a cradle. The cradle has front and rear portions 56 and 58 separated by a gap 60. The rear portion 58 terminates at a transverse stop wall 61. Each cradle portion has three U-shaped seats for receiving and supporting conductors therein. A second set of three ledges 62 spans the gap 60. The nadir of the cradle seats matches the height of the ledges 54 and 62. The ledges are aligned with the openings in the conductor entry structure 22. Thus, the ledges in combination with the cradle seats provide continuous underlying support for conductors inserted into the connector housing. The seats provide lateral support as well, thereby trapping the conductors in position.

Turning now to the cover 14, FIGS. 1-3 illustrate that the cover provides the sixth side of the enclosure defined by the housing 10. The primary structural member of the cover is a plate 64 having interior and exterior surfaces. The exterior surface of the plate is strengthened by side walls 66, an end wall 68, longitudinal ribs 70 and transverse ribs 72. The longitudinal ribs taper into the hinge 16. A test port hole 74 is formed between the ribs and through the plate 64 to allow insertion of a test probe for checking electrical potential prior to performing work on the circuit.

Three latches are cantilevered from the exterior edge of the end wall 68. Each latch comprises a pair of arms 76 joined by a bail 78. The outside arms of the outer latches merge with the side walls 66. A hook 80 is formed on each bail for engagement with the catch 50 on the case. The ramp surfaces 48 and hooks 80 are located such that when the cover is closed there is a slight interference between them. However, the rounded ramp surface and the angled hook surface permit them to slide relative to one another, with the closing force flexing the latch arms away from end wall 68. This flexing slightly preloads the latch arms so when the hooks finally slide off the ramp surface 48 into engagement with the catch 50 there is a tactile and audible snap of the latch arms back to their relaxed position. Engagement of the catch 50 and hooks 80 prevents reopening of the housing.

Figure 7:
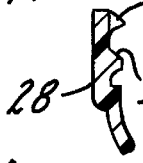
FIG. 7 is a section through a portion of a side wall of the case showing the pre-latch lugs, taken along line 7—7 of FIG. 6.

The interior surface of the plate 64 has a pair of flanges 82 extending from the sides near the hinge 16. The outside edges of these flanges mount first and second dogs 84 and 86. The dogs have a rectangular shape. They protrude from the flanges and are sized and located so as to engage the similarly protruding lugs 30 and 32 of the case 12. As illustrated in FIG. 7, the lugs 30, 32 have an angled upper surface and a relatively flat underside. Upon application of sufficient force, the dogs will slide past the angled surfaces of the lugs (accompanied by some flexing of the flanges 82 and the offset portions 28 of case side walls 24) and become interlocked with the flat underside of the lugs.

The natural resiliency of the connector hinge is such that its relaxed state is in the fully open position of FIGS. 4 and 5. To make the connector more convenient to use, it is desirable to partially close it at the time of manufacture. Thus, the connector is supplied to the user in the partially closed or pre-latched condition of FIG. 1. In this position the first dogs 84 have been moved past the first lugs 30 to engage the flat undersides of the lugs 30. This prevents the connector from springing back to its fully open, flat condition. The positioning of the second dogs 86 and second lugs 32 is such that in the pre-latched condition the second dogs 86 engage the angled upper surface of second lugs 34. This places a pre-load on the second dogs that mildly resists further closure.

This pre-load helps prevent premature full closure of the cover when a user inserts a first wire into the housing. To understand how premature closure might otherwise be a problem, consider in FIG. 1 how a user will naturally grip the cover and case. Most likely the grip will be between a thumb and forefinger. Then when a wire is inserted it will bottom on stop wall 61. This will push the connector back and tend to exert a closing force on the cover. The second dog 86 and second lug 32 will prevent such premature closure because the force required to push the dog past the lug is greater than the inadvertent closing force arising from insertion of a wire.

The cover further includes a socket formed on the interior surface of the plate 64. The socket receives the conductive clip. The socket comprises two transverse barriers 88. The barriers have scalloped upper edges. Each barrier has two shoulders 90 which assist in retaining the clip. Frangible retainers 92 are formed along the side edges of the plate 64. These retainers are shown in FIG. 3 in their condition prior to installation of a conductive clip 94. After insertion of a clip into the socket, the retainers 92 are bent over the ends of the clip as by heat staking or the like. See FIG. 4. The shoulders may also be melted slightly to allow them to flow between the tine pairs of the clip. Together the barriers 88, shoulders 90 and retainers 92 are sufficiently rigid to prevent any movement of the clip 94 in a plane parallel to the plate 64. They will also hold the clip in the socket under normal handling and jostling. But the frangible retainers 92 and shoulders 90 will break loose and the clip will come out of the socket if an attempt is made to open a connector after installation on conductors. Thus, the connector is for one time use only.

Figure 8:
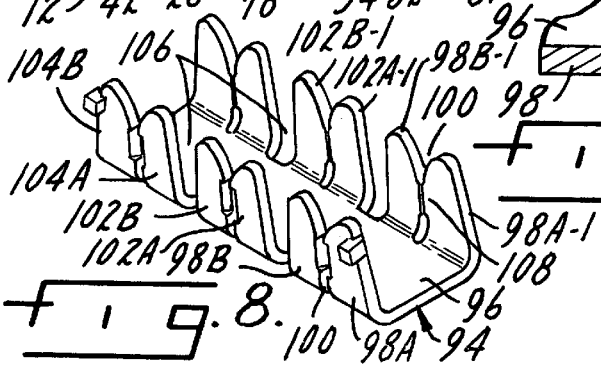
FIG. 8 is a perspective view of the conductive clip.
Figure 9:
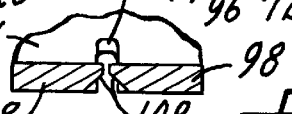
FIG. 9 is a section through a pair of adjacent tines, showing the coined portions thereof.
Figure 10:
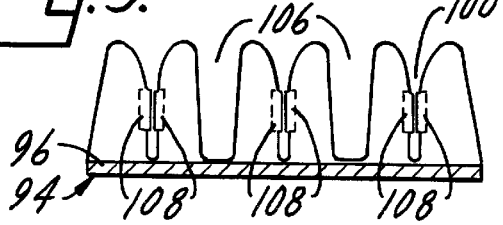
FIG. 10 is a longitudinal section through a clip.

Having described the housing, attention is now turned to the conductive clip 94. It is shown in FIGS. 8–10. The clip is made from copper alloy, for example, Olin brass #CA7025 although other alloys are possible. The clip 94 has a flat, rectangular base 96 which engages the plate 64 of the cover. A plurality of tines 98 extend upwardly from the base. The clip base 96 is mounted flush against the plate 64 so as to distribute closing forces over a substantial portion of the cover. This avoids stress concentrations along an edge of the tines that could otherwise cause failure of the housing, i.e., the tines could burst through the cover plate and become exposed to the exterior. This is especially important in the present connector which is intended to be closed by pliers and not by hand.

The tines are grouped in pairs, such as 98A and 98B, which are closely adjacent one another and define a conductor-receiving slot 100 between them. Other tine pairs are shown at 102A,B and 104A,B. The pairs of tines are separated by larger gaps 106. Pairs of tines on opposite sides of the base are aligned with one another to form a set of tines. For example, tine pair 98A-1 and 98B-1 is aligned with pair 98A, 98B and together all four tines 98 form a set. Each set of tines will receive one conductor. Thus, each conductor is gripped by two pairs of tines, thereby increasing the holding power of the connector. The tines have a rounded free end forming something of a notch to help feed a conductor into the slots 100.

The facing edges of a tine pair are coined, as at 108. As seen in FIGS. 9 and 10, the coining creates an area of decreased tine thickness and decreased slot width. The coining causes the metal of adjacent tines to flow together, into an area where the conductor is going to lie. The coined areas serve the same purpose as a knife-edge without the expense of forming a knife edge on every tine. Coining is much simpler to achieve than true knife edges. Still, the coined tines will penetrate even tough insulation materials such as nylon on top of PVC. The coined areas also create additional friction to prevent a conductor from pulling out of the clip.

As best seen in FIG. 6, the tines 98, 102 and 104 are angled with respect to the base 96. This angle in chosen in conjunction with the size of the cover 14 and case 12 such that as the cover is closed on the case, the tines will be presented to the conductors in a plane substantially perpendicular to the axis of the conductors. In the embodiment shown the tines are angled about 6 degrees from vertical, when the base is horizontal. This presentation is advantageous in terms of decreased closing force and increased reliability of the connection, i.e., the tines are sure to cut through the insulation rather than getting bent out of shape.

Figure 11:
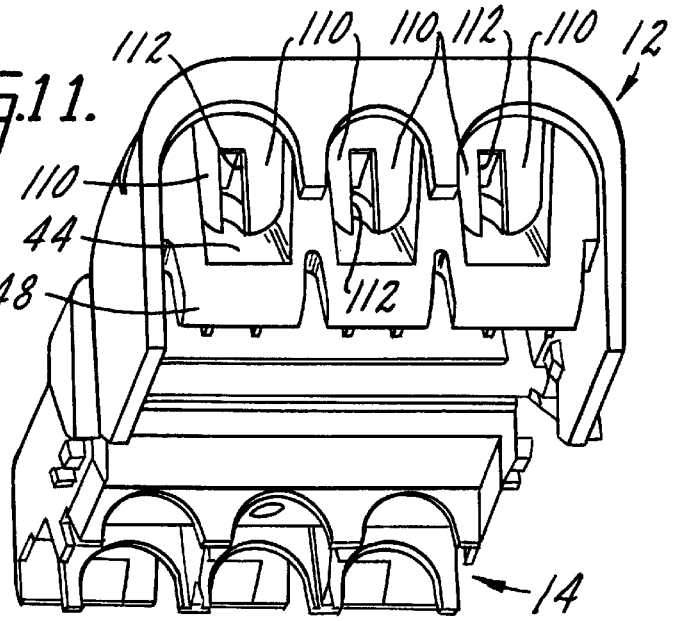
FIG. 11 is an underside perspective view of an alternate embodiment of a connector, looking at the end of the case having the wire insertion openings.
Figure 12:
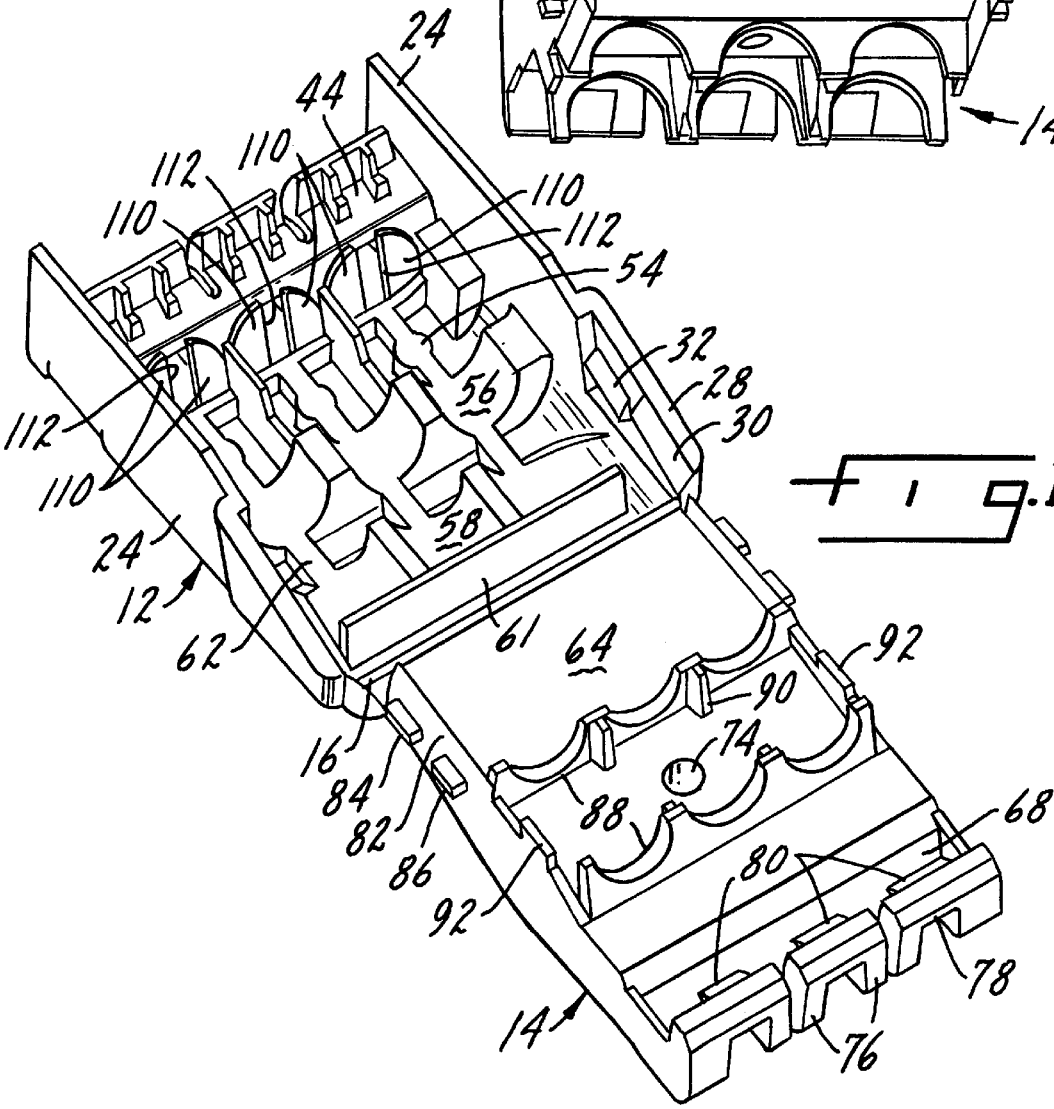
FIG. 12 is a perspective of the connector of FIG. 11, looking at the interior of an open connector.

FIGS. 11 and 12 illustrate an alternate embodiment which is substantially similar to that shown in FIGS. 1–10 except for the addition of retention webs 110. These webs extend partially across the openings, leaving only a small slot 112. The slot width is less than the outside diameter of wires to be inserted. Thus, the webs will retain a wire before a user has a chance to close the cover. This is useful to retain wires when inserting the subsequent wire in a group. It also helps hold the connector on the wires while the preliminary closure is made and then the final closure with pliers.

The use, operation and function of the invention are as follows. Having prepared two or more electrical wires for connection, a user will insert a wire into the housing. This is done by pushing the wire through a stirrup 38 toward an opening 47. The guide wall 44 will direct the wire through a bridge 46 and over the lip 26 into the case 12. Insertion continues until the wire abuts the stop wall 61. At this point the wire is supported by ledges 54, 62 and the cradle 56, 58. If retention webs 110 are present they will deter the connector from dislodging while the above process is repeated for the second and third wires. As mentioned above the first dog 84 and lug 30 hold the cover partially closed while the second dog 86 and lug 32 are engaged to prevent premature closing. In the pre-latched condition the clip may contact the insulation of the wires but no cutting of the insulation takes place. The user can then reach for pliers. The jaws of the pliers are placed against the ribbed exterior surfaces of the case and cover. Squeezing the handles of the pliers will exert a closing force on the housing that will drive the tines of the conductive clip through the wires' insulation and into contact with the underlying conductors. One line of tines will end up in the gap 60 between the cradle portions 56, 58. The other line of tines will fit between the front cradle portion 56 and the guide wall 44.

During the closing process the closing forces on the clip 94 are distributed throughout the substantial area of the base 96 in contact with the plate 64. The socket will withstand any forces tending to dislodge the clip. Since the tines are all joined by the base 96, electrical connection from one wire to the next is made. As the housing closes the hooks 80 will engage the catches 50 as described above to lock the housing closed.

The closing force of the pliers will also drive second dog 86 past the angled upper surface of lug 32 so the dog engages the flat underside of the lug. This provides a secondary closure retention in that in the event of failure of the hinge 16, the second dogs and lugs will retain the cover in a closed condition.

The connector as shown and described can be used on any combination of 18 through 12 gauge stranded and/or solid conductors, with or without insulation, and in any arrangement. Placing the conductive clip inside the housing allows a one-step closure to be achieved. Reinforcing the cover and case exterior surfaces as shown plus distributing the force on the clip over a relatively large area allows use of a hand tool without damage to the housing.

While a preferred form of the invention has been shown and described, it will be realized that alterations and modifications may be made thereto without departing from the scope of the following claims. For example, while the tines of the clip are angled with respect to the base to provide the desired angle of attack, the desired angle of attack could be imparted by other means such as an angled surface on the inside wall of the cover. Further, while the conductor openings are described as being in the case and the clip is mounted on the cover, these locations could be reversed. The specific locations of the openings and clip is not important, only that they are in different halves of the housing. The number of conductor openings could be other than the three shown. An additional conductive clip could be placed in the case so that four pairs of tines engage each wire. Alternately, the clip could be split so there would be one row of tines mounted in the cover and one row of tines mounted in the case.

What is claimed is:

1. A connector for electrically connecting to each other at least two conductors which are covered by insulation, comprising:

an insulative housing including a case and a cover connected to the case by at least one hinge, the hinge defining an axis, the cover being pivotable about said axis to close on the case;

the cover including a plate defining interior and exterior surfaces;

at least two openings in the case for receiving elongated, insulated conductors to be connected;

a conductive clip attached to the cover, the clip having a generally flat base member and a plurality of tines extending from said base member and defining at least two conductor-receiving slots, the tines being arranged to pierce the insulation around a conductor and engage the conductor when the cover is closed on the case, and the base member being mounted in engagement with the interior surface of the plate; and first and second lugs on one of the cover or case and first and second dogs on the other of the cover or case, the first dog being engageable with the first lug to hold the cover in a partially closed condition, and the second dog being engageable with the second lug when the cover is in said partially closed condition to resist further closure.

2. A connector for electrically connecting to each other at least two conductors which are covered by insulation, comprising:

an insulative housing including a case and a cover connected to the case by at least one hinge, the hinge defining an axis, the cover being pivotable about said axis to close on the case;

at least two openings in one of the case or cover for receiving elongated, insulated conductors to be connected;

a conductive clip attached to the other of the case or cover, the clip having a plurality of tines extending from said other of the case or cover at an angle such that when the cover and case are moved relative to one another about the hinge axis to a closed position the tines will impinge on the conductors in a plane substantially normal to the axis of the conductors and pierce the insulation around a conductor to engage the conductor; and first and second lugs on one of the cover or case and first and second dogs on the other of the cover or case, the first dog being engageable with the first lug to hold the cover in a partially closed condition, and the second dog being engageable with the second lug when the cover is in said partially closed condition to resist further closure.

3. A connector for electrically connecting to each other at least two conductors which are covered by insulation, comprising:

an insulative housing including a case and a cover connected to the case by at least one hinge, the hinge defining an axis, the cover being pivotable about said axis to close on the case;

the cover including a plate defining interior and exterior surfaces;

at least two openings in the case for receiving elongated, insulated conductors to be connected;

a conductive clip attached to the cover, the clip having a generally flat base member and a plurality of tines extending from said base member and defining at least two conductor-receiving slots, the tines being arranged to pierce the insulation around a conductor and engage the conductor when the cover is closed on the case, the tines extending from the base member at an angle such that when the cover and case are moved relative to one another about the hinge axis to a closed position the tines will impinge on the conductors in a plane substantially normal to the axis of the conductors and the base member being mounted in engagement with the interior surface of the plate;

a socket formed on the interior surface of the plate, the clip being disposed within the socket and being restrained thereby from movement in a plane parallel to the plate; and frangible retainers connected to the plate and engageable with the clip to hold the clip in the socket under normal loads, the retainers being breakable to release the clip from the socket when subjected to forces sufficient to open a previously installed connector.

4. The connector of claim 3 wherein the clip has at least two pairs of tines extending from said base, the tines of each pair having adjacent edges for receiving a conductor therebetween and engaging said conductor, the adjacent edges having coined portions formed therein.

5. A connector for electrically connecting to each other at least two conductors which are covered by insulation, comprising:

an insulative housing including a case and a cover connected to the case by at least one hinge, the hinge defining an axis, the cover being pivotable about said axis to close on the case;

the cover including a plate defining interior and exterior surfaces;

at least two openings in the case for receiving elongated, insulated conductors to be connected;

a conductive clip attached to the cover, the clip having a generally flat base member and a plurality of tines extending from said base member and defining at least two conductor-receiving slots, the tines being arranged to pierce the insulation around a conductor and engage the conductor when the cover is closed on the case, and the base member being mounted in engagement with the interior surface of the plate;

a socket formed on the interior surface of the plate, the clip being disposed within the socket and being restrained thereby from movement in a plane parallel to the plate; and frangible retainers connected to the plate and engageable with the clip to hold the clip in the socket under normal loads, the retainers being breakable to release the clip from the socket when subjected to forces sufficient to open a previously installed connector.

6. The connector of claim 5 wherein the clip has at least two pairs of tines extending from said base, the tines of each pair having adjacent edges for receiving a conductor therebetween and engaging said conductor, the adjacent edges having coined portions formed therein.

7. A connector for electrically connecting to each other at least two conductors which are covered by insulation, comprising:

an insulative housing including a case and a cover connected to the case by at least one hinge, the hinge defining an axis, the cover being pivotable about said axis to close on the case;

at least two openings in one of the case or cover for receiving elongated, insulated conductors to be connected;

a conductive clip attached to the other of the case or cover, the clip having a plurality of tines extending from said other of the case or cover at an angle such that when the cover and case are moved relative to one another about the hinge axis to a closed position the tines will impinge on the conductors in a plane substantially normal to the axis of the conductors and pierce the insulation around a conductor to engage the conductor;

a socket formed on the interior surface of the plate, the clip being disposed within the socket and being restrained thereby from movement in a plane parallel to the plate; and frangible retainers connected to the plate and engageable with the clip to hold the clip in the socket under normal loads, the retainers being breakable to release the clip from the socket when subjected to forces sufficient to open a previously installed connector.

8. The connector of claim 7 wherein the clip has at least two pairs of tines, the tines of each pair having adjacent edges for receiving a conductor therebetween and engaging said conductor, the adjacent edges having coined portions formed therein.

9. A connector for electrically connecting at least two conductors, comprising:

an insulative housing including a case and a cover connected to the case by at least one hinge, the hinge defining an axis, the cover being pivotable about said axis to close on the case;

at least two openings in one of the case or cover for receiving elongated conductors to be connected, the openings being defined by a bottom wall, first and second side walls, at least one partition intermediate the side walls, and a transverse guide wall connecting the side walls and partition, at least the guide wall being angled toward the opening so as to funnel conductors thereto; and a conductive clip attached to the other of the case or cover, the clip having at least two pairs of tines extending from said other of the case or cover, the tines of each pair having adjacent edges for receiving a conductor therebetween and engaging said conductor.

10. The connector of claim 9 further comprising at least one retention web extending at least partially across the path of entry of a conductor into the housing and engageable with an inserted conductor to retain the conductor in the housing prior to closure thereof.

11. A connector for electrically connecting at least two conductors, comprising:

an insulative housing including a case and a cover connected to the case by at least one hinge, the hinge defining an axis, the cover being pivotable about said axis to close on the case;

at least two openings in one of the case or cover for receiving elongated conductors to be connected;

a conductive clip attached to the other of the case or cover, the clip having at least two pairs of tines extending from said other of the case or cover, the tines of each pair having adjacent edges for receiving a conductor therebetween and engaging said conductor; and first and second lugs on one of the cover or case and first and second dogs on the other of the cover or case, the first dog being engageable with the first lug to hold the cover in a partially closed condition, and the second dog being engageable with the second lug when the cover is in said partially closed condition to resist further closure.

12. The connector of claim 11 wherein the second dog is engageable with the second lug when the cover is in a fully closed condition to resist reopening of the connector.

13. A connector for electrically connecting at least two conductors, comprising:

an insulative housing including a case and a cover connected to the case by at least one hinge, the hinge defining an axis, the cover being pivotable about said axis to close on the case;

at least two openings in one of the case or cover for receiving elongated conductors to be connected;

a conductive clip attached to the other of the case or cover, the clip having at least two pairs of tines extending from said other of the case or cover, the tines of each pair having adjacent edges for receiving a conductor therebetween and engaging said conductor; and frangible retainers connected to said other of the case or cover and engageable with the clip to hold the clip to said other under normal loads, the retainers being breakable to release the clip from said other of the case or cover when subjected to forces sufficient to open a previously installed connector.

14. The connector of claim 13 further comprising a socket formed on said other of the case or cover, the clip being disposed within the socket and being restrained thereby from movement in a plane parallel to said other of the case or cover.

15. The connector of claim 13 the clip having at least two pairs of tines, the tines of each pair having adjacent edges for receiving a conductor therebetween and engaging said conductor, the adjacent edges having coined portions formed therein.

16. The connector of claim 13 further comprising first and second lugs on one of the cover or case and first and second dogs on the other of the cover or case, the first dog being engageable with the first lug to hold the cover in a partially closed condition, and the second dog being engageable with the second lug when the cover is in said partially closed condition to resist further closure.

* * * * *